US005203296A

United States Patent [19]

Hart

[11] Patent Number: 5,203,296

[45] Date of Patent: Apr. 20, 1993

[54] FLAME ARRESTER HAVING HELICAL FLAME ARRESTING MEMBER

[75] Inventor: James P. Hart, Grosse Point, Mich.

[73] Assignee: Barbron Corporation, Detroit, Mich.

[21] Appl. No.: 865,490

[22] Filed: Apr. 9, 1992

[51] Int. Cl.[5] ..... F23D 14/82

[52] U.S. Cl. ..... 123/198 D; 431/346; 55/DIG. 20

[58] Field of Search ..... 123/198 D, 52 MF, 52 M; 431/346; 48/192; 55/DIG. 20; 60/39.11

[56] References Cited

U.S. PATENT DOCUMENTS

| | | | |
|---|---|---|---|
| 892,660 | 7/1908 | Getty . | |
| 1,826,487 | 10/1931 | Wiggins . | |
| 2,042,537 | 6/1936 | Liddell . | |
| 2,420,599 | 5/1947 | Jurs . | |
| 2,683,472 | 7/1954 | Specht . | |
| 3,287,094 | 11/1966 | Brownell . | |
| 3,884,201 | 5/1975 | Cregan | 123/52 MV |
| 3,889,649 | 6/1975 | Polaner | 123/142 |
| 3,903,646 | 9/1975 | Norton | 48/192 |
| 3,954,092 | 5/1976 | Polaner | 123/142 |
| 4,015,954 | 4/1977 | Reed | 48/192 |
| 4,375,204 | 3/1983 | Yamamoto | 123/52 M |
| 4,538,555 | 9/1985 | Kite | 123/52 MB |
| 4,909,730 | 3/1990 | Roussakis et al. | 431/346 |
| 4,975,098 | 12/1990 | Lee et al. | 431/346 |
| 5,072,704 | 12/1991 | Webb | 123/195 E |

*Primary Examiner*—David A. Okonsky
*Attorney, Agent, or Firm*—Basile and Hanlon

[57] ABSTRACT

A flame arrester comprises a continuous flame arresting member in the form of a helix having offset interstices between adjacent turns of the helix. The flame arrester further comprises a mechanism for housing the flame arresting member. Upon installation of the flame arrester on a carburetor, air intake system, or any source of flammable gases, any backfire or flame passing through the flame arrester will be extinguished. A method for making the flame arresting member comprises the step of forming a plurality of projections in a continuous, flattened flame arresting material having a predetermined uniform curvature such that the material naturally forms a helix having a plurality of turns of a predetermined diameter, wherein a plane containing the width lies substantially perpendicular to the axis of the helix, the plurality of projections being formed such that they extend outwardly from the surface of the helix, and such that, when adjacent turns of the helix abut each other, offset interstices between the adjacent turns are formed.

21 Claims, 2 Drawing Sheets

FLAME ARRESTER HAVING HELICAL FLAME ARRESTING MEMBER

BACKGROUND OF THE INVENTION

The present invention relates generally to flame arresters, and more particularly to such a flame arrester which includes a continuous, helical flame arresting member.

Various flame arresters have been known in the art. Flame arresters are desirable in areas where combustible gas and air are mixed in order to prevent flame from progressing and causing subsequent damage and danger to equipment and people. A flame arrester usually includes a structure having a plurality of small channels through which the gas flows, the channels usually being formed of metal and normally at a temperature well below the ignition temperature of the gas. As flame moves through the interstices of the arrester, it will be cooled to a temperature below the combustion point and the gas flame will be extinguished.

Most of the known flame arresters are formed of many individually stacked plates. In flame arresters of this type, as well as other known arresters such as those formed of many pie-like sections, the flame arresting elements must be formed out of many separate sections or components. Often this is done by hand, which is time consuming, tedious and labor intensive, thereby costing the manufacturer a great deal of money. If such a process is automated, the machining must be dedicated to exact dimensions of a particular flame arrester, and a whole set of different machining must be utilized in order to vary the size or shape of a particular flame arrester.

In U.S. Pat. No. 3,287,094 issued to Brownell, the arrester element 30 is formed of one piece having sections 32 folded into spaced parallel relationship. The folding process constitutes an additional manufacturing step which is also costly and time consuming. Flame arresters of this type further may be undesirable due to the fact that, in order to obtain optimal flow characteristics with larger volumes of combustible gases while still retaining effective flame quenching, due to the amount of surface area and mass necessary, the resultant flame arrester would be too large and cumbersome for practical use.

Thus, it is an object of the present invention to provide a flame arrester having a one piece, continuous, helical flame arresting member which is easily and advantageously manufactured without any costly, labor intensive time expenditures. Further, it is an object of the present invention to provide a flame arrester which will present an optimal mass and surface area to a flame front with a more economical use of available space. Still further, it is an object to provide a process to make such a flame arrester which utilizes essentially the same manufacturing equipment with slight modification in order to make various sizes of flame arresters, thereby advantageously making more efficient use of the manufacturing facilities. Yet still further, it is an object of the present invention to provide a process to make such a flame arrester which will produce a flame arresting member with little or no waste of raw material.

SUMMARY OF THE INVENTION

The present invention addresses and solves all the problems enumerated above. The present invention comprises a flame arrester including a continuous flame arresting member in the form of a helix having offset interstices between adjacent turns of the helix. The flame arrester further comprises means for housing the flame arresting member. Upon installation of the flame arrester on a carburetor, air intake system, or source of flammable gas, any backfire or flame passing through the flame arrester will be extinguished.

A method for making the flame arresting member comprises the step of forming a plurality of projections in a continuous, flattened flame arresting material having a predetermined uniform curvature such that the material naturally forms a helix having a plurality of turns of a predetermined diameter, wherein a plane containing the width lies substantially perpendicular to the axis of the helix, the plurality of projections being formed such that they extend outwardly from the surface of the helix, and such that, when adjacent turns of the helix abut each other, offset interstices between the adjacent turns are formed.

BRIEF DESCRIPTION OF THE DRAWINGS

Other objects, features and advantages of the present invention will become apparent by reference to the following detailed description and drawings, in which.

DETAILED DESCRIPTION OF THE PREFERRED EMBODIMENTS

Figure 1:
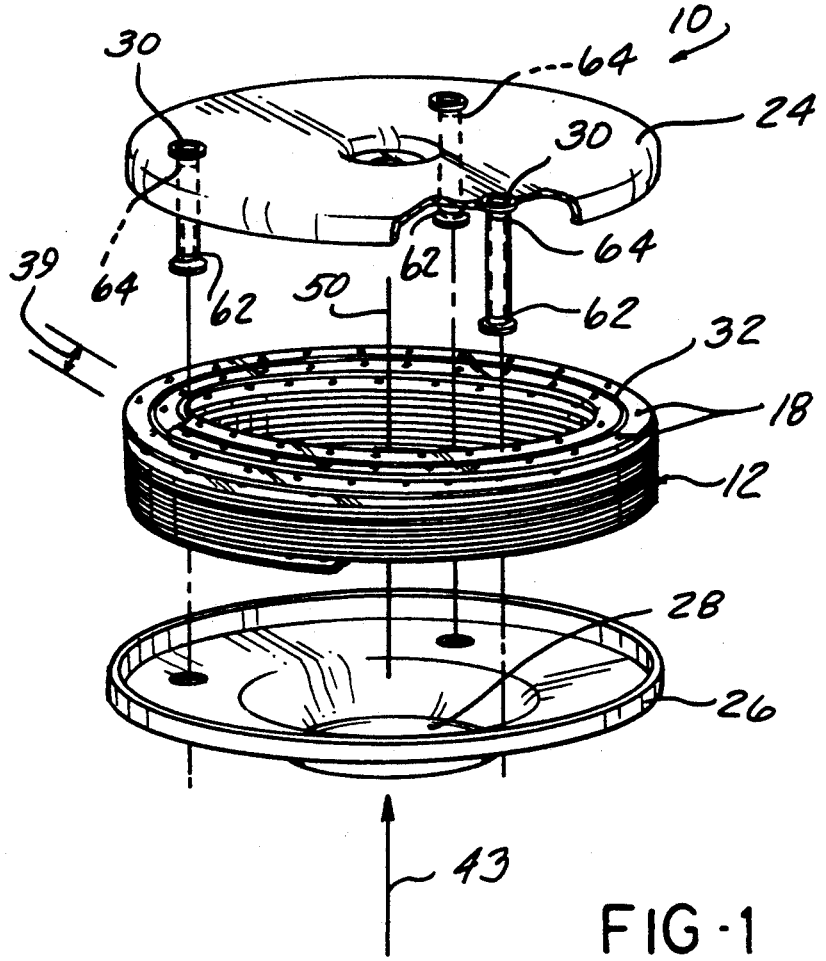
FIG. 1 is an exploded perspective view of the flame arrester of the present invention.
Figure 2:
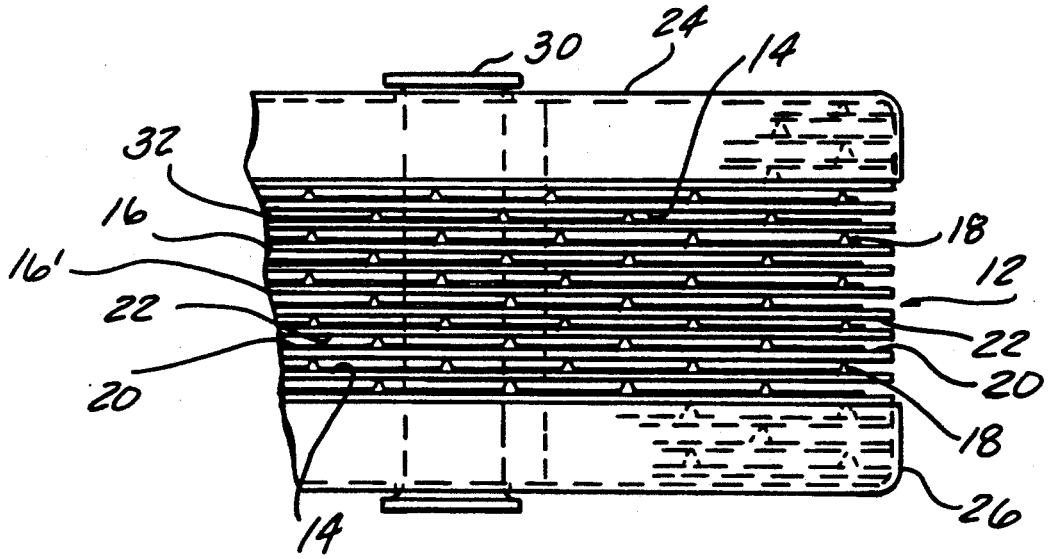
FIG. 2 is an enlarged, partially cut away side view showing the offset projections forming interstices between adjacent turns of the helical flame arresting member.

Referring now to FIG. 1, a flame arrester according to the present invention is designated generally as 10. The flame arrester 10 comprises a continuous flame arresting member or element 12 in the form of a helix having offset interstices 14 between adjacent turns, such as 16 and 16', as best seen in FIG. 2. The interstices 14 may be formed by any suitable structure, however, in the preferred embodiment, they are formed by a plurality of offset projections 18 extending outwardly from the surface 20 of the helix and abutting against an adjacent surface 22 of the adjacent turn.

The flame arrester 10 further comprises means for housing flame arresting member 12. This housing means may comprise any suitable means. In the preferred embodiment, the housing means comprises a cover 24 extending over the flame arresting member 12, relative to the flame arrester 10 installation position, and relative to the flame arrester 10 position as shown in FIG. 1. A base 26 receives the bottom of the flame arresting member 12, relative to the positions described above. Base 26 further contains an opening 28 adapted to receive a carburetor, fuel injected, tuned port or other induction system (not shown). The housing means further comprises means for securing cover 24 to base 26 with flame arresting member 12 held therebetween. This securing means may comprise any suitable means, including rivets, bolts, tie rods, or the like. However, in the preferred embodiment, the securing means comprises a rivet 30.

Flame arrester 10 is ideally suited for marine use on inboard motors. Upon installation of flame arrester 10 on a carburetor or air intake system (not shown), any backfire or flame passing through the flame arrester 10 will be extinguished. Flame arrester 10 may be made in various diameters and heights, depending upon a particular need. The flame arrester 10 is also suitable for non-marine engine uses, such as off road vehicles and the like. The flame arrester 10 can also be used in pipes conveying flammable gases, as for example, in pipes for venting fuel storage tanks. The open area of interstices 14 will relieve pressure, while the large amount of surface area comprising the upper and lower surfaces of each adjacent turn of the helix, as well as the offset projections 18, will tend to dissipate any volatile vapors.

Flame arrester 10 may optionally comprise a continuous, longitudinal stiffening groove 32 formed in the helix, which groove 32 may vary in width from a narrow width to one which extends the full width of the turn 16. Groove 32 may also function to deflect air flow and improve flame quenching characteristics.

Flame arresting member 12 may be formed of any suitable flame arresting material, such as aluminum, brass, stainless steel, or any corrosion resistant material. In the preferred embodiment, flame arresting member 12, as well as cover 24, base 26 and rivets 30, is formed of 5052 work hardening aluminum.

Figure 3A:
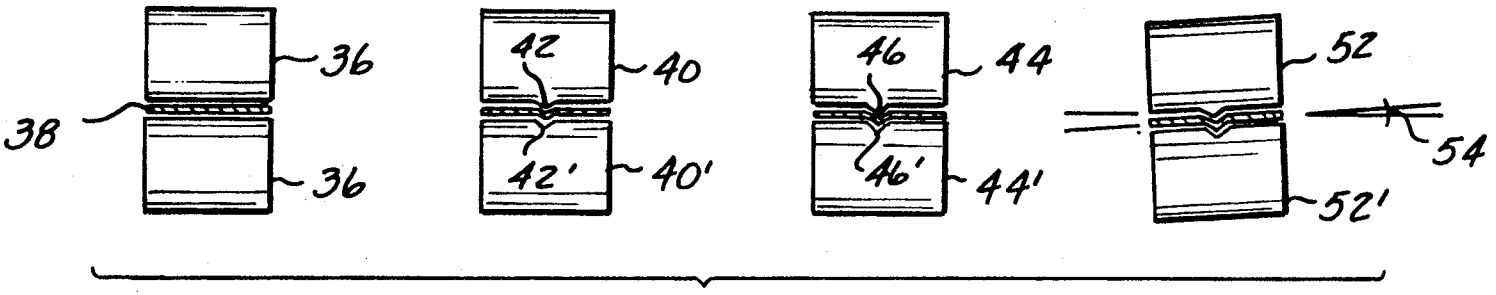
FIG. 3A is a schematic view of the four drive rolls used in the method of the present invention.
Figure 3B:
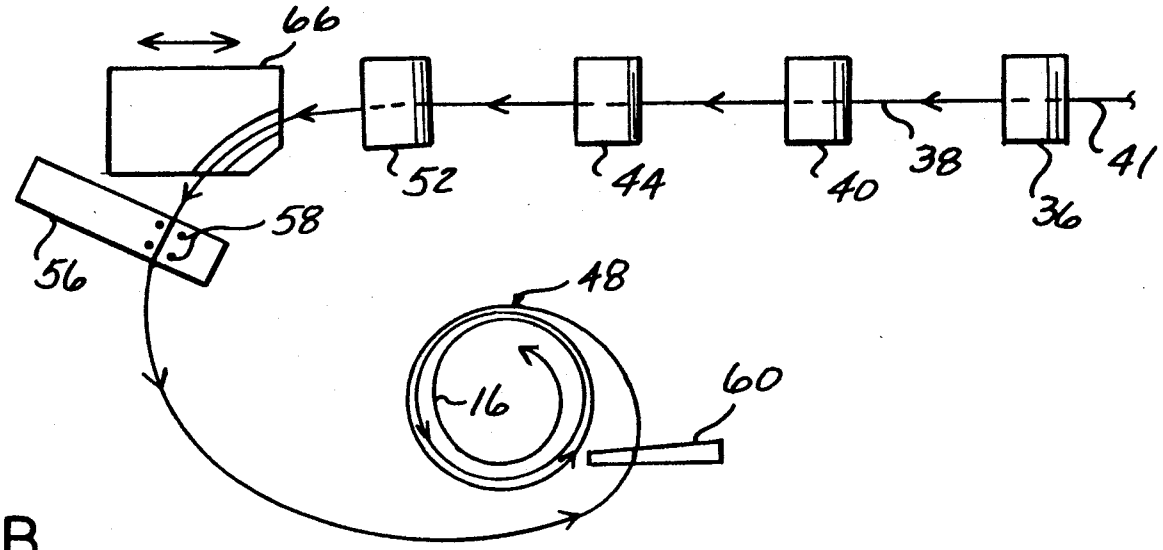
FIG. 3B is a schematic top view of the method of the present invention.

Referring now to FIGS. 3A and 3B, a method for making a flame arresting member 12 for extinguishing any flame passing through member 12, comprises the following steps. A continuous supply of flame arresting material, such as a roll 41 of flattened aluminum strip or ribbon 38, is guided forward, as by rollers 36. Ribbon 38 has a width 39, as shown in FIG. 1. A continuous, longitudinal groove 32 may be formed by complementary rollers 40, 40', with roller 40 having a projection 42 and roller 40' having a complementarily shaped groove 42'. Groove 32 may be finished, as by complementary rollers 44, 44' having the complementarily shaped projection 46 and groove 46', as described above.

A predetermined uniform curvature is imparted to the flattened flame arresting material 38 such that the material 38 naturally forms a helix 48 having a plurality of turns 16 of a predetermined diameter, wherein a plane containing width 39 lies substantially perpendicular to the axis 50 of helix 48. This uniform curvature may be imparted by any suitable means, including canted or conical rollers. However, in the preferred embodiment, canted rollers 52, 52' are used. Rollers 52, 52' roll flattened flame arresting material 38 greater on one side than on the other, lengthening that side and thereby forcing the uniform curvature. In order to vary the diameter of flame arresting member 12, both the pressure and angle 54 are varied, as well as the angle of the forming shoe 66.

A plurality of projections 18 are formed in the flattened flame arresting material 38 such that the plurality of projections 18 extend outwardly from the surface 20 of the helix, and such that, when adjacent turns (such as 16, 16') of the helix abut each other, offset interstices 14 between the adjacent turns are formed. This plurality of projections 18 may be formed by any suitable means, including by rollers having complementarily shaped projections and detents. However, in the preferred embodiment, the flattened material 38 is stamped with a pneumatic die 56 having dimples 58 thereon. Die 56 is programmed to operate such that projections 18 on adjacent turns 16, 16' will not coincide, thereby causing undesirable nesting of the adjacent turns. This can be accomplished in many ways, such as on alternating turns 16, 16' having die 56 stamp at time (t) for one turn 16 and time (t+x) for an adjacent turn 16', x constituting an additional predetermined increment.

After a predetermined number of turns 16 have been formed of the flattened flame arresting material 38, it is cut from the supply 41, as by a suitable cutter 60. After flame arresting member 12 has been cut from supply 41, it is assembled into a flame arresting unit in the following way. Rivets 30 are staked onto base 26. Flame arresting member 12 is placed on base 26 and surrounds rivets 30. The bottommost turn 16 is caught on groove 62 on rivet 30, and the uppermost turn 16 is caught on groove 64 on rivet 30. Cover 24 is then placed on top of flame arresting member 12, with rivets 30 extending through corresponding apertures in cover 24. Rivets 30 are then headed, thereby securing flame arresting member 12 between cover 24 and base 26.

The width 39 and the thickness of a turn 16 of flame arresting member 12, as well as the height of projections 18, and the height of longitudinal groove 32, may all be determined as desired to fit a particular end use. The height of interstices 14 (directly related to the height of projections 18) cannot be too small for the desired use, as there would be insufficient air flow through the interstices 14. At the same time, the height cannot be too large, as this would pass a flame through member 12. One reasonably skilled in the art will be able to determine optimum dimensions for the various components of flame arrester 10.

In a preferred embodiment, a turn 16 of the flame arresting member 12 is about 0.25 mm (0.01 inch) thick and about 16 mm (0.63 inch) wide, the projections 18 extend outwardly about 0.76 mm (0.03 inch), and longitudinal groove 32 extends outwardly about 0.51 mm (0.02 inch).

The overall cylindrical shape of flame arrester 10 is more effective than conventionally used flame arresters. Without being bound to any theory, it is believed that this advantageous effect is partially due to the diffusion of the flame front. Since the propagated flame flows in the direction shown by arrow 43 in FIG. 1, it is partially deflected by cover 24 before flowing through flame arresting member 12. This deflection by the cover 24 lowers the pressure of the flame, thereby further enhancing the flame arresting action. It is further believed that the advantageous effect is also partially due to flame arrester 10 presenting a greater surface area to the flame front than do generally known flat flame arresters.

While preferred embodiments of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. A flame arrester, comprising:

a continuous flame arresting member in the form of a helix having offset interstices between adjacent turns of the helix; and means for housing the flame arresting member;

wherein, upon installation of the flame arrester on a source of flammable gases, any flame passing through the flame arrester will be extinguished.

2. The flame arrester as defined in claim 1 wherein the housing means comprises:

a cover extending over the flame arresting member, relative to the flame arrester installation position;

a base receiving he bottom of the flame arresting member, relative to the flame arrester installation position; and means for securing the cover to the base with the flame arresting member held therebetween.

3. The flame arrester as defined in claim 2 wherein the securing means comprises a rivet.

4. The flame arrester as defined in claim 2 wherein the securing means comprises one of a bolt and a tie rod.

5. The flame arrester as defined in claim 2 wherein the base contains an opening adapted to receive the source of flammable gases.

6. The flame arrester as defined in claim 1 wherein the interstices are formed by a plurality of offset projections extending outwardly from the surface of the helix and abutting against an adjacent surface of the adjacent turn.

7. The flame arrester as defined in claim 1 wherein a continuous, longitudinal stiffening groove is formed in the helix.

8. The flame arrester as defined in claim 1 wherein the flame arresting member is formed of aluminum.

9. The flame arrester as defined in claim 1 wherein the flame arresting member is formed of a corrosion resistant material.

10. A flame arrester for extinguishing any backfire or flame passing through the flame arrester when installed on a carburetor or air intake system, the flame arrester comprising:

a continuous, 5052 work hardening aluminum flame arresting member in the form of a helix having offset interstices between adjacent turns of the helix;

a continuous, longitudinal stiffening groove formed in the helix; and means for housing the flame arresting member, wherein the housing means comprises:

a cover extending over the flame arresting member, relative to the flame arrester installation position;

a base receiving the bottom of the flame arresting member, relative to the flame arrester installation position, the base further having an opening adapted to receive the carburetor or air intake system; and a rivet for securing the cover to the base with the flame arresting member held therebetween.

11. A method for making a flame arresting member for extinguishing any flame passing through the member, the method comprising the step of:

forming a plurality of projections in a continuous, flattened flame arresting material having a predetermined uniform curvature such that the material naturally forms a helix having a plurality of turns of a predetermined diameter, wherein a plane containing the width lies substantially perpendicular to the axis of the helix, the plurality of projections being formed such that they extend outwardly from the surface of the helix, and such that, when adjacent turns of the helix abut each other, offset interstices between the adjacent turns are formed.

12. The method as defined in claim 11, further comprising the step of forming a continuous longitudinal groove in the flattened flame arresting material.

13. The method as defined in claim 12, further comprising the step of cutting the flattened flame arresting material from a supply source after a predetermined number of turns have been formed.

14. The method as defined in claim 12 wherein the flame arresting material is formed of aluminum.

15. The method as defined in claim 12 wherein the flame arresting material is formed of a corrosion resistant material.

16. A method for making a flame arresting member for extinguishing any flame passing through the member, the method comprising the steps of:

imparting a predetermined uniform curvature to a flattened flame arresting material such that the material naturally forms a helix having a plurality of turns of a predetermined diameter, wherein a plane containing the width lies substantially perpendicular to the axis of the helix;

forming a plurality of projections in the flattened flame arresting material such that the plurality of projections extend outwardly from the surface of the helix, and such that, when adjacent turns of the helix abut each other, offset interstices between the adjacent turns are formed; and cutting the flattened flame arresting material from the supply after a predetermined number of turns have been formed.

17. The method as defined in claim 16, further comprising the step of forming a continuous longitudinal groove in the flattened flame arresting material.

18. A method for making a flame arrester for extinguishing any backfire or flame passing through the flame arrester when installed on a carburetor or air intake system, the method comprising the step of:

forming a plurality of projections in a continuous, flattened flame arresting member having a predetermined uniform curvature such that the material naturally forms a helix having a plurality of turns of a predetermined diameter, wherein a plane containing the width lies substantially perpendicular to the axis of the helix, the plurality of projections being formed such that they extend outwardly from the surface of the helix, and such that, when adjacent turns of the helix abut each other, offset interstices between the adjacent turns are formed, the flame arresting member being disposed within a housing after being cut from a supply source after a predetermined number of turns have been formed.

19. The method as defined in claim 18, further comprising the step of forming a continuous longitudinal groove in the flattened flame arresting member.

20. The method as defined in claim 19 wherein the housing comprises a cover extending over the flame arresting member, relative to the flame arrester installation position, and a base receiving the bottom of the flame arresting member, relative to the flame arrester installation position, the base further having an opening adapted to receive the carburetor or air intake system, the method further comprising the step of:

securing the cover to the base with the flame arresting member held therebetween.

21. The method as defined in claim 20 wherein a turn of the flame arresting member is about 0.25 mm thick and about 16 mm wide, the projections extend outwardly about 0.76 mm, and the longitudinal groove extends outwardly about 0.51 mm.

* * * * *